United States Patent [19]

Teach

[11] 3,953,145

[45] Apr. 27, 1976

[54] LASER BEAM CONTROL SYSTEM FOR EARTHWORKING OR SIMILAR MACHINES

[75] Inventor: Ted L. Teach, Springfield, Ohio

[73] Assignee: Laserplane Corporation, Dayton, Ohio

[22] Filed: Mar. 12, 1975

[21] Appl. No.: 557,572

Related U.S. Application Data

[63] Continuation-in-part of Ser. No. 378,171, July 11, 1973, Pat. No. 3,873,226.

[52] U.S. Cl. ..... 404/84; 172/4.5

[51] Int. Cl. ..... E01c 19/00; E02f 3/76

[58] Field of Search ..... 404/84; 37/DIG. 19, 37/DIG. 20; 172/4.5; 73/510, 490; 318/577, 587; 356/4, 172

[56] References Cited

UNITED STATES PATENTS

| | | | |
|---|---|---|---|
| 3,604,512 | 9/1971 | Carter et al. | 404/84 |
| 3,791,452 | 2/1974 | Long et al. | 172/4.5 |

*Primary Examiner*—Malcolm F. Hubler
*Assistant Examiner*—S. C. Buczinski
*Attorney, Agent, or Firm*—W. A. Schaich

[57] ABSTRACT

Apparatus for controlling the elevation of the working tool of an earthworking machine, or the pavement distributor head of a mobile road-paving machine, in predetermined relationship to a fixed horizontal plane, as set by a laser beam which is periodically swept across the working area, such apparatus comprising a tape-dispensing device carried by the machine and arranged to intermittently advance the tape past a tape reader; the tape carrying two sets of indicia, one set indicating whenever a change in the height of the tool is required at a particular point in the travel of the machine, and the second set of indicia indicating the distance between such points, there being a ground-engaging wheel measuring the travel of the machine and connected to the tape-dispensing device to advance the tape to the next set of indicia whenever the machine arrives at the next one of said predetermined points.

6 Claims, 5 Drawing Figures

LASER BEAM CONTROL SYSTEM FOR EARTHWORKING OR SIMILAR MACHINES

GENERAL BACKGROUND OF THE INVENTION

This application constitutes a continuation-in-part of my application Ser. No. 378,171 filed July 11, 1973, now U.S. Pat. No. 3,873,226.

In U.S. Pat. No. 3,588,249 and 3,494,426, to Robert H. Studebaker, there is described apparatus for maintaining a predetermined vertical relationship between the elevation of the working tool of an earthworking machine and a fixed horizontal reference plane. As described in the aforesaid Studebaker patents, such apparatus comprises a laser beam generating device remote from the machine which periodically sweeps a laser beam along a multitude of paths lying in said horizontal reference plane, and a servo system, including a laser beam receiver carried by the machine, for sensing the height of the laser beam plane and for raising or lowering the elevation of the earth-engaging tool to maintain a predetermined difference between the tool and the laser beam reference plane. To change the predetermined relationship between the laser beam reference plane and the tool of the earthworking machine along the path of travel of the machine according to the teachings of the aforesaid Studebaker patents, for example, to increase or decrease the elevation of a roadbed being graded at predetermined locations, and to thereby establish grade breaks or vertical curves, it was necessary to manually locate each of such predetermined locations by conventional surveying techniques and then to manually re-set the servo system of the machine as it reached each such location. This, of course, involved considerable work and expense, especially in regard to road paving machines where grade specifications are normally considerably more narrow than in the case of earth grading machines, and this requirement has heretofore substantially impeded the application of the laser plane control system to both grading and road paving systems.

In accordance with the disclosure of my aforesaid copending application Ser. No. 378,171, however, it has been found that the laser plane elevation control system of the aforesaid Studebaker patent can be successfully and economically applied to road paving machines, as well as to earth working machines, and without the need to establish, by manual surveying techniques during the operation, the elevation of a very great number of locations very closely spaced to one another along the length of the road being paved in order to generate grade breaks or vertical curves within acceptable standards.

In accordance with the disclosure of my aforesaid copending application Ser. No. 378,171, any earthworking machine, and particularly a road paving machine, may be provided with a coil or reel of tape which is unwound onto the earth surface being worked or the new pavement being laid, as the machine moves along its intended path of travel. This tape is provided with periodically spaced indicia which indicates the distance travelled by the machine and the desired elevation at each point along the machine path where an elevation change is desired. The machine is provided with a servo system that includes a tape reader for reading the indicia on the tape and for changing the predetermined distance between the laser plane and the elevation of the earthworking tool, or the pavement distributor of a paving machine, which is then established by the laser beam transmitter.

A minor disadvantage of the aforedescribed system is the fact that a reel of tape must be prepared which is equally as long as the path of travel of the earthworking or road paving machine. When working on relatively flat, straight sections of a road, many feet of tape may be dispensed without there being any necessity for changing the elevational setting of the tool of the earthworking machine or the height of the distributor of the paving machine. Additionally, while my previous invention provided for a visual comparison of the height of the tool as called for by the indicia on the tape, with the actual height of the tool as mechanically measured, the possibility of the operator not visually noticing when a departure occurs between two such indicia permits undetected errors to persist, hence indicating the desirability of an automatic alarm system which will be actuated whenever there is a difference between the actual height and the desired height of the earthworking tool or the distributor of the paving machine.

OBJECTS OF THE INVENTION

Accordingly, it is an object of the present invention to provide an improved elevation control system for the tool of an earthworking machine or the paving distributor of a paving machine. More particularly, it is an object of the present invention to provide a height-controlling system based on the combination of a laser beam and a tape carrying indicia for accurately controling the elevation of the earthworking tool of an earthworking machine or the distributor of a paving machine in accordance with a predetermined plan as developed in advance by the surveyors or engineers on a particular project.

A particular object of the invention is to provide a laser beam actuated control system for normally controlling the elevation of the earthworking tool of an earthworking machine or the distributor of a paving machine with respect to a laser beam reference plane, and changing such height only at predetermined points along the planned path of the earthworking machine or the paving machine according to indicia that are applied to a tape which is intermittently moved past a reading station in response to the travel of the machine along the planned path to the next one of said predetermined points.

Other objects and advantages of the invention will become apparent to those skilled in the art from the following detailed description, taken in conjunction with the annexed sheets of drawings.

DETAILED DESCRIPTION OF THE INVENTION

While not limited thereto, the present invention will be described in connection with the control of the height of the distributor of a paving machine, but it should be distinctly understood that the principles of the invention are equally applicable to the control of the tool of an earthworking machine, such as the blade of a grader, the pan of a scraper, or any other type of tool where frequent changes in the elevation of the earthworking tool may be required along the path of the machine, or where the pitch of the tool must be varied in order to impart a tilt in the vertical plane of the earch surface after passage of the machine thereover. Also, it should be understood that while the invention will be first described solely in connection with moving the entire distributor of a paving machine, or similarly, the entire earthworking tool of an earthworking machine, merely by duplicating the system and applying a control system to each lateral end of the paving distributor or the earthworking tool, the vertical elevation of one end of the tool relative to the other may be varied at will to provide any desired vertical tilt of the resulting pavement being laid or earth surface being graded.

Figure 1:
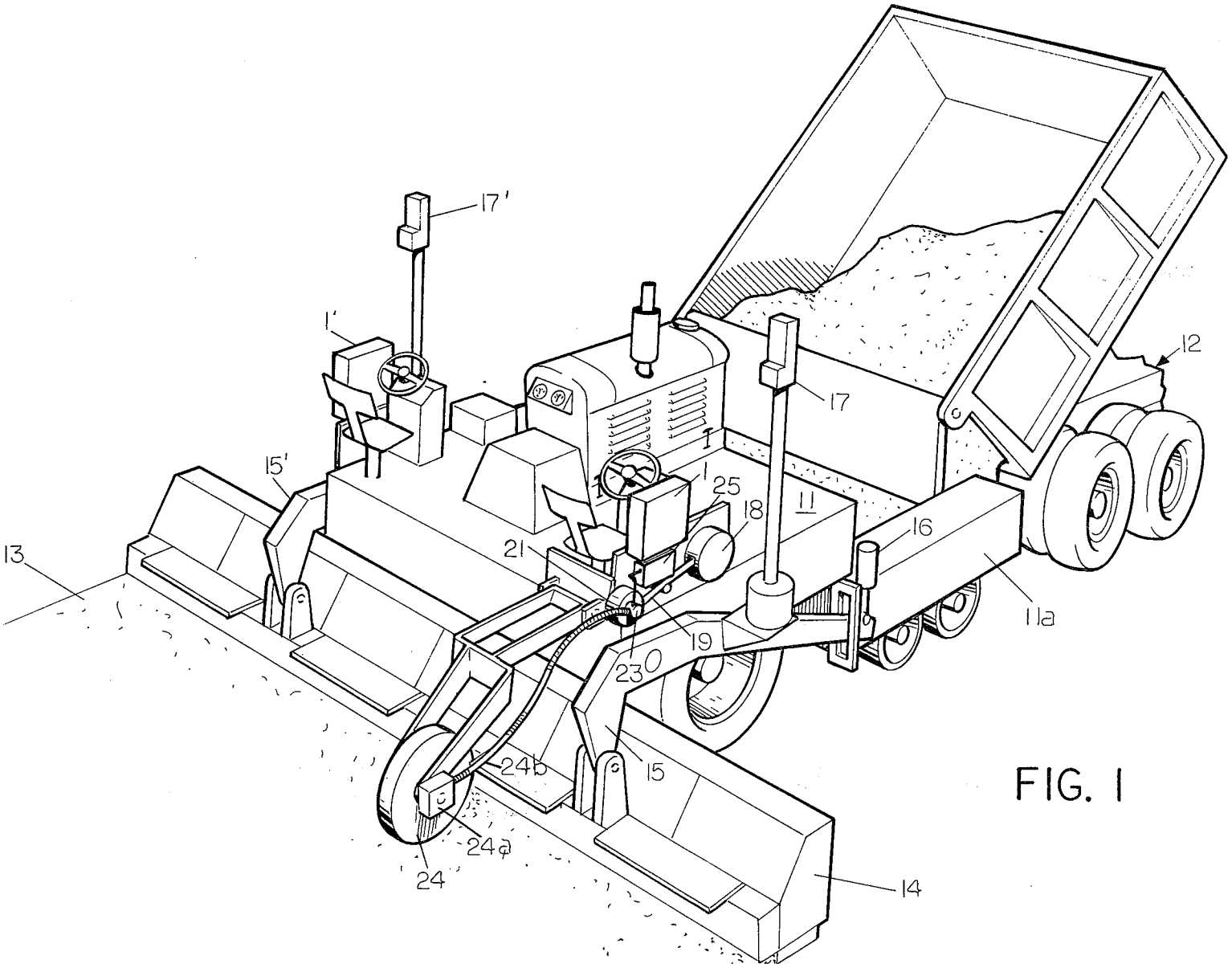
FIG. 1 is a perspective view of a self-propelled type of bituminous paving machine incorporating a control system in accordance with the present invention for its paving distributor.

Referring to FIG. 1, the control system of the present invention is illustrated as applied to a bituminous paving machine, shown generally at 11. For purposes of illustration, paving machine 11 may be considered to be of the self-powered type manufactured by the Construction Equipment Division of Blaw-Knox Company under the designation PF-220, except as is otherwise hereinafter specifically described. Paving machine 11 is shown as receiving a fresh load of bituminous paving material in a hopper portion 11*a* at its front end from a conventional dump truck 12, shown fragmentarily. A thin laterally extending layer of bituminous paving material 13 is applied to the road bed by one or more generally laterally extending pavement distributors, here shown as a single distributor 14 which desirably is slightly tilted in a vertical plane so that the resulting pavement slopes at a slight angle as it extends from the center of the road toward the edge, in order to properly crown the road for the drainage of water therefrom.

Since the bed of the road being paved is generally not graded to elevation specifications as stringent as those to which the road must be paved, variations in grading are overcome by making the vertical elevation of distributor 14 adjustable relative to the road bed, to apply paving material thereto in varying depth as the paving machine moves along its intended path of travel. Vertical adjustability of distributor 14 is accomplished by mounting same at the load ends of first class lever arms 15 and 15', the other or force end of which is connected to the end of the cylinder rod of hydraulic cylinders 16 respectively. Hydraulic fluid is controllably admitted under pressure to either side of the pistons of cylinders 16 to raise or lower the force end of arms 15 and 15' to thereby lower or raise the load end thereof.

As is explained in the aforesaid Studebaker U.S. Pat. No. 3,588,249, and also in U.S. Pat. No. 3,494,426, to Robert H. Studebaker, the control of hydraulic fluid to and from hydraulic cylinders 16 to maintain distributor 14 at a predetermined elevation may be controlled by a control system which senses the elevation of a reference plane through which a laser beam is periodically swept. To that end, machine 11 is provided with a vertically extending laser beam receiving device 17 which may be of the type described in my prior U.S. Pat. No. 3,825,808. If the tilt of distributor 14 is to be varied for a curve, a second beam-receiving device 17' is also provided.

Figure 2:
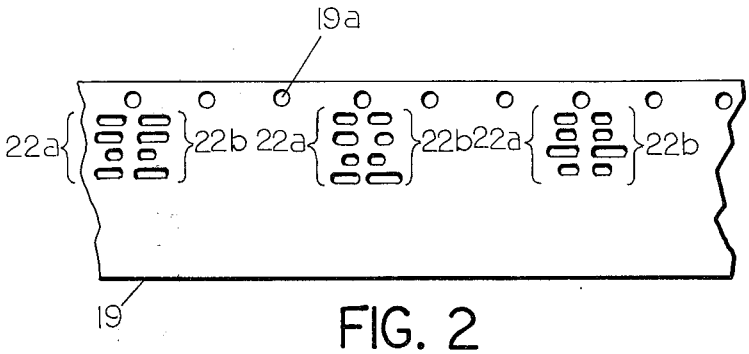
FIG. 2 is a fragmentary plan view of a typical portion of the tape utilized to control the elevation of the distributor of the paving machine of FIG. 1 in accordance with the present invention.

Typically, a laser beam receiving device of such a type is capable of adjustment in elevation, relative to the elevation of one end of the pavement distributor, in increments of 0.01 feet over a total range of adjustment of 5 feet, there thereby being 500 different predetermined relasionships between the elevations of the laser beam receiver and the controlled pavement distributor which can be selected by the operator. See, for example, the receiver and mast disclosed in Studebaker U.S. Pat. No. 3,494,426. This fact can be used to advantage to automatically control the grade of the paved surface at a non-horizontal angle, or an angle which is not parallel to the plane along which the laser beam is projected, by providing means to automatically select a different one of the 500 of such predetermined relationships as the machine travels to each of a plurality of different points along its planned path of travel from a known starting location. These various points where elevational changes in the height of the working tool, or portion thereof, is required can be spotted on the master survey or plan for the particular operation. Each change in elevation is then transferred to a flexible tape 19, which is normally held in a rolled position on the machine by a tape reel 18, and is intermittently pulled past a reading station of a reader 25 by a feeding roll 21. Referring more particularly to FIG. 2, it will be seen that a typical tape has a series of equally spaced holes 19*a* along one of its edges to provide for positive actuation of the tape by the feeding mechanism 21. According to this invention, the tape bears two distinct sets of indicia 22*a* and 22*b*. The indicia 22*a* indicate the distance from one point along the planned path of travel of the machine to the next point at which a change in elevation of a portion of the paving distributor or earthworking tool is required. The indicia 22*b* indicates the magnitude and direction of the change in elevation to be accomplished when the machine reaches such predetermined point. The two sets of indicia 22*a* and 22*b* are equally spaced along the tape, and the feeding mechanism 21 is periodically actuated to move the tape by a distance equal to the spacing between the successive sets of indicia by a stepping motor 23 which, in turn, is periodically actuated in response to the distance travelled by the machine 10 through a control mechanism 24*a* governed by a ground-engaging wheel 24 and flexible cable 24*b*. Indicia 22*a* and 22*b* may comprise any conventional binary code series of punched holes, as described in more detail in my aforesaid copending application Ser. No. 378,171.

The remainder of the control circuit, housed in panel 1, is substantially identical to that described in my aforesaid copending application. At the start of the paving operation, the tape is pulled through reader 25 and is positioned with the indicia 22*b* corresponding to the starting point of the machine being located at the reader station. Hence indicia 22*b* will indicate the desired elevation of the paving distributor 14 at that point. More significantly, the starting indicia 22*a* indicates to the tape reader 25 the distance that the machine must travel along its planned path before any change in elevation of the distributor 14 is required.

Tape reader 25 will read indicia 22*b* and deliver the height information provided by such indicia in binary code to a memory circuit 26. The memory circuit 26, in turn, activates a driver 27 which is operatively connected to an electronic digital display panel 28. At the same time, the position of the vertically adjustable laser beam receiver 17 is mechanically sensed and is indicated on a mechanical counter 29 with a digital display, preferably mounted closely adjacent electronic digital display 28 at the operator's station so that equivalent readings on the two devices can be quickly verified by a glance.

As the paving machine 11 moves along its intended path of travel, it will reach the first point where it is desired to effect an elevation change, changes usually being made in increments of 0.01 feet, for the type of laser beam receivers heretofore described.

At this point, a pulse will be delivered by the distance measuring mechanism 24*a* to the tape feeder or dispenser 21 and cause the tape to be advanced by the incremental distance between the sets of binary code indicia 22*a* and 22*b* so that a new set of indicia are positioned opposite the reader's station of the reader 25. Assuming that the instructions of the binary set 22*b* are different than that which was previously utilized in the control circuit, these new instructions are read by the reader 25 and the information is simultaneously passed to memory circuit 26 and to a comparator circuit 31. The comparator circuit will sense that the desired position is greater or less than that indicated by the information stored in the memory circuit and will then feed a signal to the "up" circuit 32, or to the "down" circuit 33, which will instruct the control box 34 to raise or lower, respectively, the laser beam receiver 17 by one increment by energizing cylinders 16. This also results in a raising or lowering of the height of the distributor 14 by the same increment. At the same time, "up" circuit 32 or "down" circuit 33, as the case may be, will cause a strobe 35 to erase the information stored in memory circuit 26 and will replace it with information as to the new elevation which is desired for the working tool or pavement distributor 14. Mechanical counter 29 will also have its digital reading correspondingly changed to show the new elevation and mechanical counter 29 and electronic digital display 28 must now each indicate the same new elevation. In case of any differences, a comparator 36 is actuated to operate an audible alarm 37, thus immediately calling the operator's attention to the discrepancy and giving him the opportunity to stop the machine and prevent further operations until the cause of the discrepancy is determined.

Figure 5:
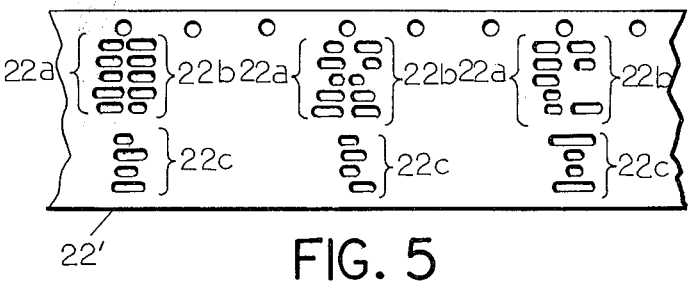
FIG. 5 is a fragmentary plan view of the tape used in the system of FIG. 4.

As previously mentioned, if it is desired to change the tilt of the paving distributor 14 or the tool of an earthworking machine, then it is only necessary to duplicate the control panel 1, here schematically shown as 1', and provide a vertically actuated laser beam receiving mast 17 and 17' respectively for each lateral end of the paving distributor 14 or the earthworking tool of the earthworking machine. In such case, the tape 22' (FIG. 5) employed would be of increased width, as indicated in FIG. 5, because an additional set of indicia 22*c* would have to be provided for separate control of each of the cylinders 16 and laser beam receiving masts 17 and 17'. The additional control system would then be housed in a panel 1', and the complete system would be as schematically illustrated in FIG. 4, wherein the same control and indicating elements would be provided as in control panel 1 to separately control the height of each end of the paving distributor 14 or the earthworking tool of an earthworking machine.

Figure 3:
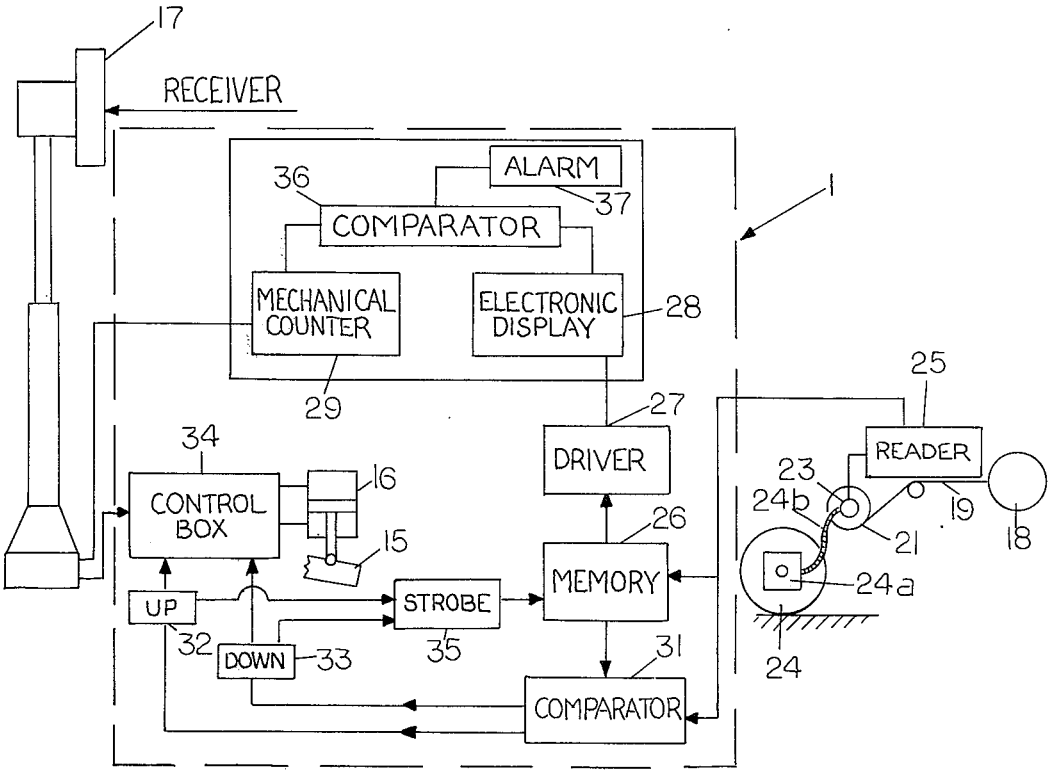
FIG. 3 is a schematic view of the control system of the paving machine incorporating this invention.
Figure 4:
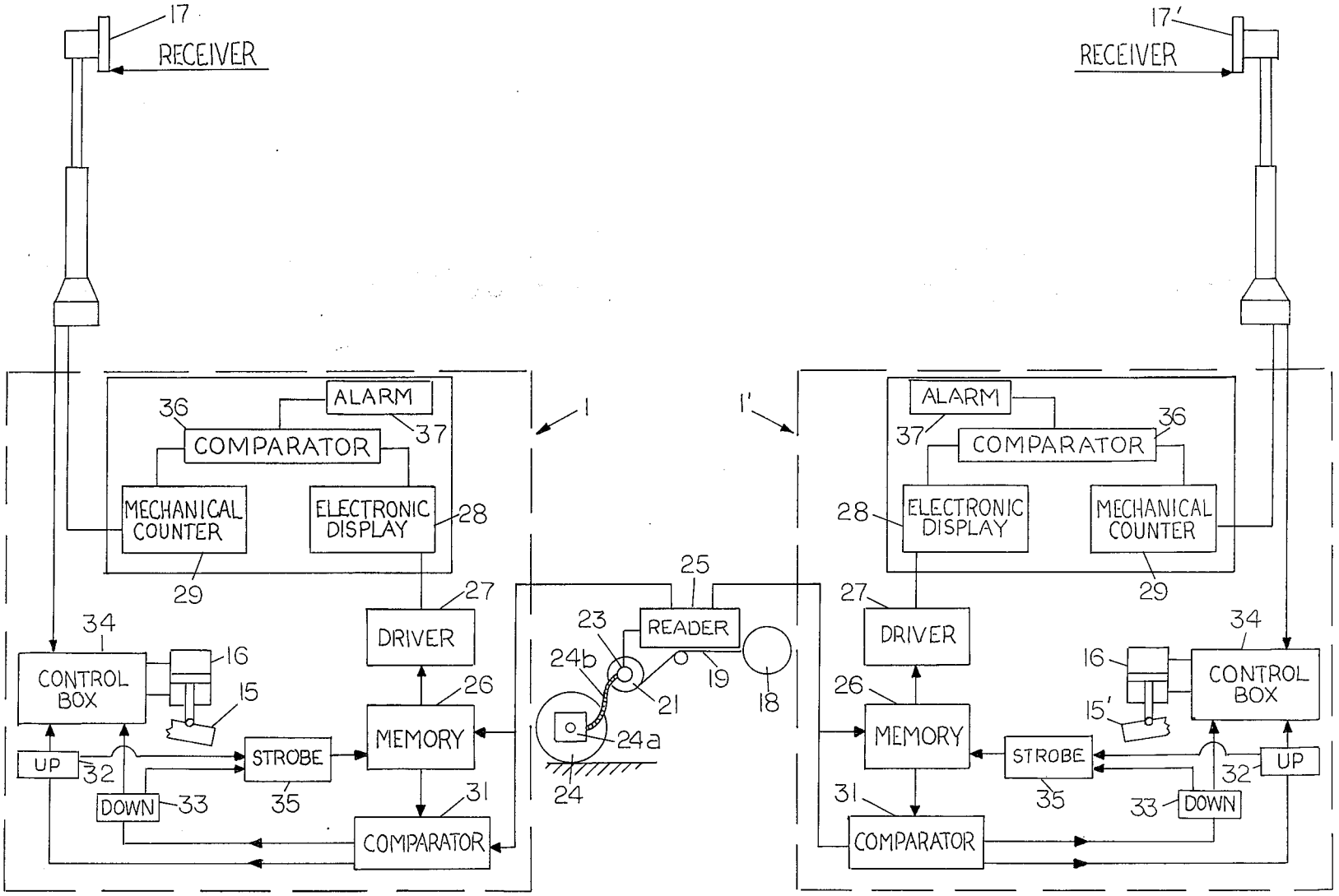
FIG. 4 is a schematic view of a modified control system for controlling the paving machine in accordance with this invention.

It should therefore be understood that the phrase employed in the claims of "controlling the height of a portion of an earthworking tool" is deliberately intended to include the system shown in FIG. 3, in which the entire tool or paving distributor is moved vertically, as well as the system shown in FIG. 4 where both ends of the working tool or paving distributor are separately moved in response to the indicia carried by the tape 22'.

The best mode known to me to carry out this invention has been described above in terms sufficiently full, clear, concise, and exact so as to enable any person skilled in the art to make and use the same. It is to be understood, however, that it is within my contemplation that certain modifications of the above-described mode of practice of the invention can be made without departing from the scope of the invention, and it is desired to limit the invention only in accordance with the appended claims.

I claim:

1. Apparatus for continuously controlling the vertical height of a portion of a vertically adjustable working tool of a mobile earthworking machine, said apparatus comprising, in combination:

means for sensing the elevation of a laser beam periodically moving over the working area in a predetermined substantially horizontal plane;

control means responsive to said laser beam for maintaining a predetermined vertical relationship between said plane and the vertical height of said tool portion; and adjustment means for changing said predetermined relationship at predetermined points along the intended path of travel of said machine, said adjustment means comprising:

1. means on the machine for intermittently advancing an indicia-bearing tape past a reader station, said tape having two sets of equally spaced indicia thereon, one set indicating each desired change in height of said portion of said tool at successive points along the path of travel of said machine, and the other set of indicia indicating the distance to be travelled by the machine until the next change in tool elevation is desired,
2. means responsive to the movement of said machine for advancing said tape past the reader station by an increment corresponding to the spacing of said indicia whenever the machine reaches the next point where a change in height of said tool portion is required, and
3. reader means at said reader station responsive to said one set of indicia and operatively associated with said control means for changing said predetermined relationship to thereby effect the desired change in height of said portion of said tool at each said point.

2. Apparatus for controlling the working height of a portion of earthworking tool carried by a mobile vehicle and vertically adjustable relative thereto by power means comprising:

1. a flexible tape having two sets of indicia thereon equally spaced along the tape, one set of indicia corresponding to desired changes in elevation of said earthworking tool portion at predetermined points along the planned path of travel of the vehicle, the other set of indicia indicating the distance between said points;

2. a feeding mechanism for said tape mounted on said vehicle and constructed and arranged to intermittently move said tape past a reading station by a distance equal to the longitudinal spacing of said indicia;
3. means responsive to movement of said vehicle for actuating said feeding mechanism each time the vehicle reaches the next one of said points;
4. electronic means for reading said indicia at said tape reading station, and
5. means for controlling said power means in response to the reading of one set of indicia, thereby adjusting the working height of said earthworking tool portion as the vehicle moves to each said point.

3. The combination defined in claim 2, plus a first digital indicating means responsive to said electronic reading means and said one indicia set on the tape for visually indicating the desired tool height as the vehicle passes each of said points.

4. The combination defined in claim 3, plus a second digital means for indicating the actual height of said working tool portion, thereby providing a direct visual comparison with said second digital indicating means.

5. The combination defined in claim 4, plus an alarm device actuated by any difference between the digital readings of said first and second digital indicating means.

6. Apparatus for continuously controlling the vertical height and tilt of a vertically adjustable working tool of a mobile earthworking machine, said apparatus comprising, in combination:

means for sensing the elevation of a laser beam periodically moving over the working area in a predetermined substantially horizontal plane;

a first control means responsive to said laser beam for maintaining a predetermined vertical relationship between said plane and the vertical height of one end of said tool; a second control means responsive to said laser beam for maintaining a predetermined vertical relationship between said plane and the vertical height of the other end of said tool; and adjustment means for changing said predetermined relationships at predetermined points along the intended path of travel of said machine, said adjustment means comprising:

1. means on the machine for intermittently advancing an indicia-bearing tape past a reader station, said tape having three sets of equally-spaced indicia thereon, two sets respectively indicating each desired change in height of said ends of said tool at successive points along the path of travel of said machine, and the third set of indicia indicating the distance to be travelled by the machine until the next change in tool elevation or tilt is desired,
2. means responsive to the movement of said machine for advancing said tape past the reader station by an increment corresponding to the spacing of said indicia whenever the machine reaches the next point where a change in height or tilt of said tool portion is required, and
3. reader means at said reader station respectively responsive to said two sets of indicia and operatively associated with said first and second control means for respectively changing said predetermined relationships to thereby effect the desired changes in height and tilt of said tool at said points.

* * * * *